United States Patent [19]

Isobe

[11] 3,973,345

[45] *Aug. 10, 1976

[54] IDENTIFICATION APPARATUS FOR A CYLINDRICAL CONTAINER

[76] Inventor: Akinori Isobe, 5-13 Honcho 2-chome, Shibuya, Tokyo, Japan

[*] Notice: The portion of the term of this patent subsequent to May 10, 1993, has been disclaimed.

[22] Filed: Aug. 3, 1972

[21] Appl. No.: 277,686

[30] Foreign Application Priority Data

Aug. 17, 1971 Japan ..... 46-62386
Dec. 31, 1971 Japan ..... 47-1955

[52] U.S. Cl. ..... 40/309
[51] Int. Cl.[2] ..... G09F 23/00
[58] Field of Search ..... 40/309, 307, 306, 51, 40/138

[56] References Cited

UNITED STATES PATENTS

| | | | |
|---|---|---|---|
| 1,549,423 | 8/1925 | Schaefer | 206/52 F |
| 1,957,329 | 5/1934 | Erne | 40/309 |
| 3,335,851 | 8/1967 | Schwartz et al. | 206/52 F |
| 3,559,324 | 2/1971 | Blair | 40/309 |
| 3,675,353 | 7/1972 | Miller et al. | 40/51 |

*Primary Examiner*—William H. Grieb

[57] ABSTRACT

An apparatus for identifying the contents of a cylindrical container. The apparatus comprises a semicircular member mounted on the peripheral surface of the container for relative rotation with respect to the container. The semi-circular member has its ends detachably connected with identification members carrying thereon an information on the contents of the container and provided with a weight mounted on the semi-circular member at the central point thereof whereby the semi-circular member is automatically caused by the weight to move to a position in which the identification members are disposed at positions ready for identification by a person when the container is placed with its end faces disposed in substantially vertical planes.

4 Claims, 7 Drawing Figures

IDENTIFICATION APPARATUS FOR A CYLINDRICAL CONTAINER

BACKGROUND OF THE INVENTION

1. Field of the Invention

The present invention relates to an identification apparatus for a cylindrical container and, more particularly, to an identification apparatus which can be used with a cylindrical container and which has identification members carrying thereon information indicating the contents of the container and which are adapted to be automatically moved or rotated relative to the container to the portions of the periphery of the container which are substantially diametrically opposed and substantially horizontally aligned when the container is placed with its flat end faces disposed in substantially vertical planes, whereby a person is enabled to readily identify a desired container without being required to ascertain the contents of containers by rotating them one after another for identification purpose.

2. Description of prior Art

Magnetic tapes for computers and the like and movie films are usually contained in cylindrical or disc-like containers so that the tapes and films are guarded against deterioration and damage. Such containers with contents therein are storaged on a shelf so that each of the containers is placed on the shelf with the flat end faces disposed in substantially vertical planes, i.e., with the axis of the container extending substantially horizontally. Each of the containers carries on one or both of the end faces identifications or marks which indicate the contents of the container so that a particular container in which a desired tape or film is contained can be identified.

Usually, such containers are placed on a shelf in end to end close contact relationship with each other with their axis substantially axially aligned. In order that the contents of the containers may be identified, each of the containers must be moved or withdrawn relative to the others to a position in which at least a part of the end faces of the withdrawn container is sufficiently exposed to enable a person to ascertain the information on the end faces of the container. This identifying operation is quite troblesome and time-consuming and, therefore, is quite disadvantageous.

In an attempt to eliminate this disadvantage, it has been proposed to put letters or marks on the peripheral surface of each of such containers at a place or places thereof so that the content of the container can be identified by the letters or marks. This proposal, while eliminating the requirement for withdrawing containers one after another from a row of the containers for identification purpose, fails to provide a satisfactory solution in that the containers carrying the identification letters or marks on the peripheral surface thereof are required to be so placed on a shelf that the letters or marks are disposed in positions just ready for identification. In order to satisfy this requirement, containers after being placed on a shelf must be re-adjusted or rotated so that the identification letters or marks are disposed at positions in which the letters or marks can be easily read by a person.

SUMMARY OF THE INVENTION

It is an object of the present invention to provide an improved identification apparatus for a cylindrical container which apparatus is free from the above-discussed disadvantage and shortcoming.

It is another object of the present invention to provide an identification apparatus of the class specified in the above and which has identification members which can be automatically moved to the portions of the peripheral surface of the container which are substantially horizontally aligned and substantially diametrically opposed when the container is placed with its end faces disposed in substantially vertical planes.

It is a further object of the present invention to provide an identification apparatus of the class specified in the above and in which a transparent cover is provided to protect the identification members from becoming soiled and damaged and in which the identification members are freely movable about the axis of the container.

It is a further object of the present invention to provide an identification apparatus of the class specified in the above and in which annular ridges are provided to extend radially outwardly of the transparent cover to protect the outer peripheral surface thereof against wear and becoming soiled and damaged for thereby maintain the transparency of the cover.

It is a still further object of the present invention to provide an identification apparatus of the class specified in the above and in which the identification members are detachably mounted on a member which is rotatable about the axis of the container so that the identification members can be easily replaced by other ones when the content of the container is exchanged.

It is a still further object of the present invention to provide an identification apparatus of the class specified in the above and which has a simplified construction and which can be economically provided on any conventional cylindrical container by slight modification thereof at the periphery thereof.

A still further object of the present invention is to provide an identification apparatus which can be removably mounted on the outer peripheral portion of a conventional cylindrical container.

A still further object of the present invention is to provide an identification apparatus of the kind specified in the preceding paragraph and which comprises a substantially annular frame member having radially inwardly extending annular, hollow or resilient flanges which are adapted to frictionally engage with the outer peripheral surface of a mating container to frictionally hold the identification apparatus on the container.

According to one feature of the present invention, there is provided an identification apparatus for a cylindrical container, said apparatus comprising a movable member rotatably mounted on the periphery of said container, said movable member having identification portions and a weight mounted on said movable member, said movable member being adapted to be rotated by the gravity of said weight with respect to said container to move said identification portions to lateral sides of the periphery of said container when it is in its vertical position whereby said identification portions can be read.

According to another feature of the present invention, there is provided an identification apparatus adapted to be mounted on a container, said apparatus comprising an annular frame of a transparent material having inwardly extending annular flanges defining therebetween a circumferential groove, a semi-circular movable member detachably received in said groove for rotation about the axis of said container, said movable member having identification portions at the ends and a weight mounted on said movable member at the central portion thereof, said frame and movable member being adapted to be removably mounted on the outer periphery of said container, said movable member being adapted to be rotated by the gravity of said weight about the axis of said container when the latter is in its vertical position whereby said identification portions can be automatically moved to lateral sides of the periphery of said container.

The above and other objects, features and advantages of the present invention will be made more apparent by the following description with reference to the accompanying drawings.

DESCRIPTION OF PREFEERED EMBODIMENTS

Figure 1:
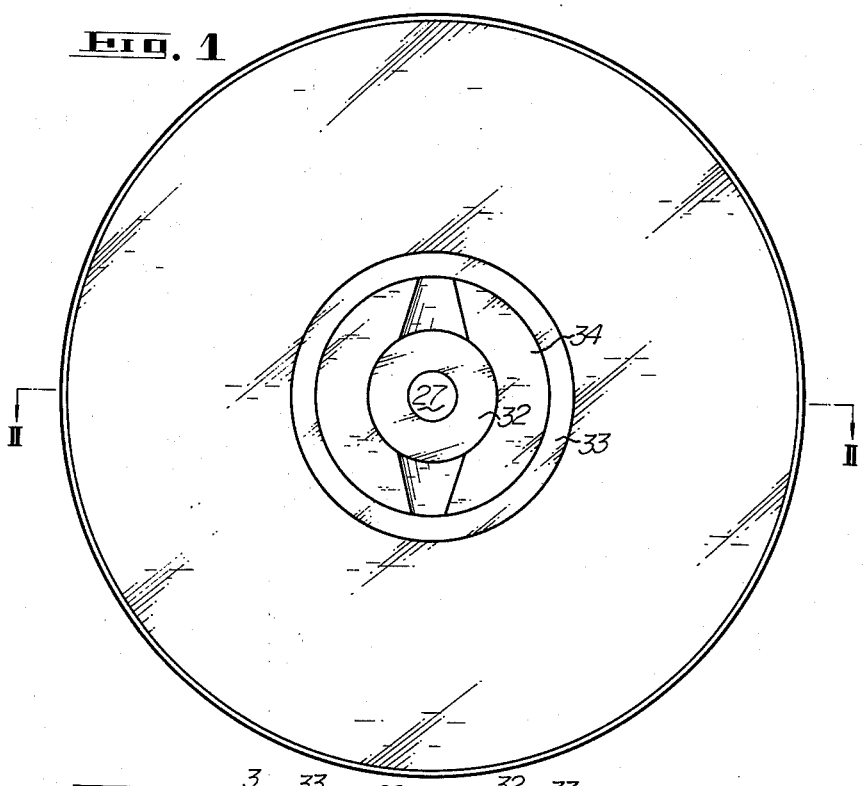
FIG. 1 is a top plan view of a cylindrical container employing an embodiment of the identification apparatus according to the present invention.
Figure 2:
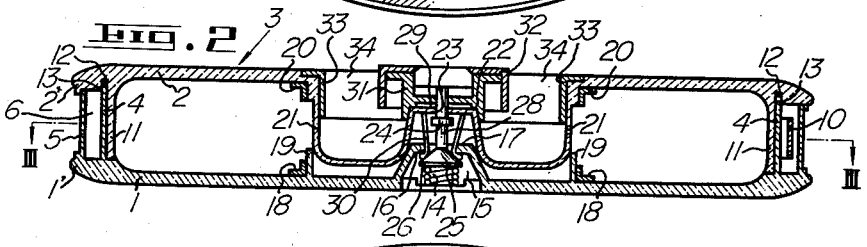
FIG. 2 is an axial sectional view of the container taken along line II — II in FIG. 1.
Figure 3:
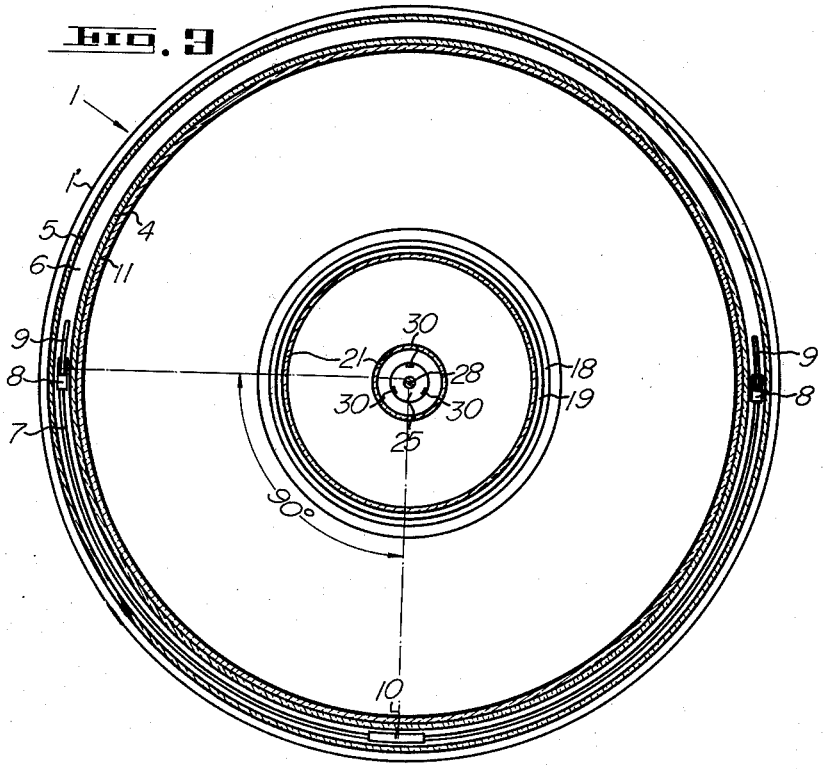
FIG. 3 is a cross-sectional view of the container taken along line III — III in FIG. 2.
Figure 4:
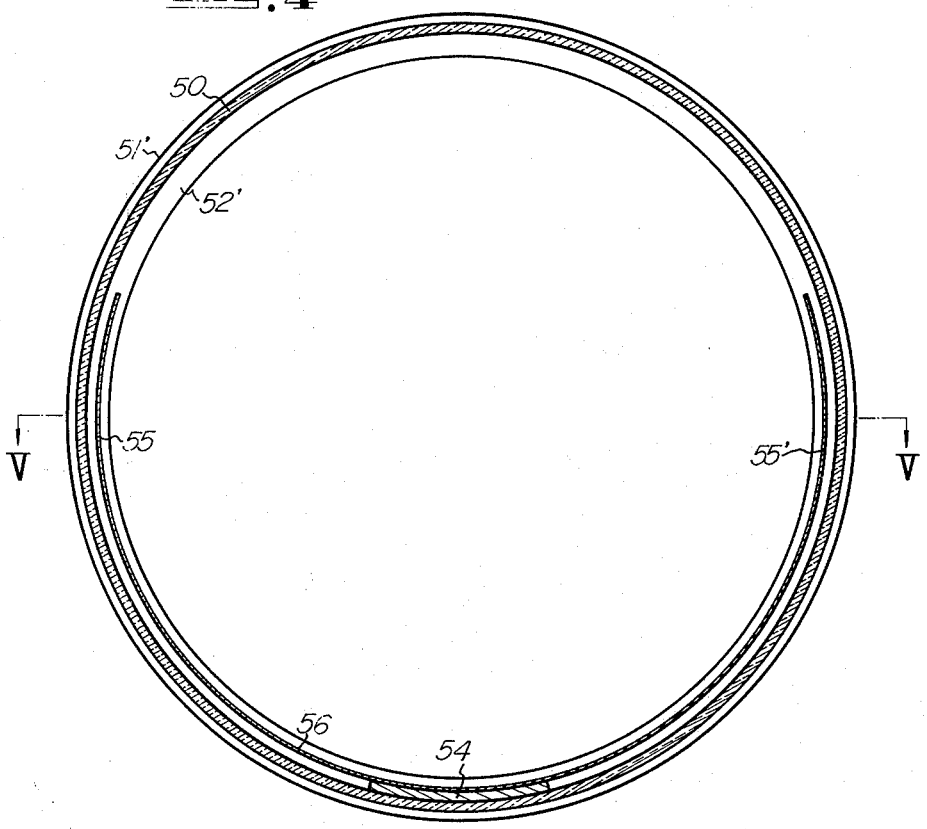
FIG. 4 is a cross-sectional view of a second embodiment of the identification apparatus according to the present invention.
Figure 5:
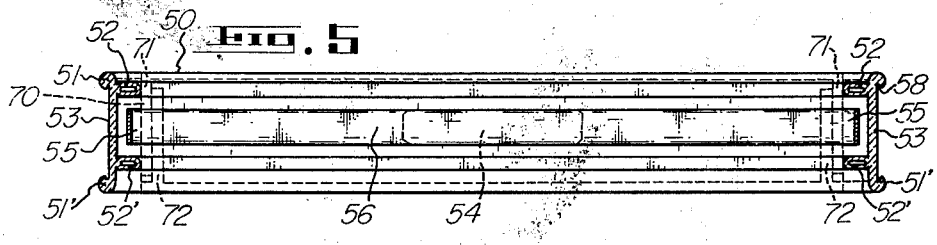
FIG. 5 is an axial sectional view of the second embodiment taken along line V — V in FIG. 4.
Figure 6:
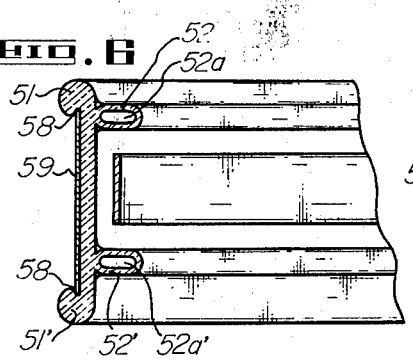
FIG. 6 is an enlarged fragmentary sectional view of the second embodiment.

Referring to FIGS. 1 to 3 of the drawings, there is shown a generally cylindrical container 3 comprising a body part 1 and a closure part 2 detachably secured to the body part 1. The body part 1 has a radially outwardly extending peripheral flange portion 1′. Similarly, the closure part 2 also has a peripheral flange port on 2′ radially outwardly coextensive with the flange portion 1′. The body part 1 is provided with a cylindrical wall 4 extending axially from the flange portion 1′ toward the flange portion 2′ of the closure part 2. The body part 1 is also provided with an outer cylindrical wall 5 of a transparent material extending axially from the flange portion 1′ toward the flange portion 2′ of the closure part 2. The cylindrical walls 4 and 5 are radially spaced a distance from each other to define therebetween an annular space 6 in which is loosely received a movable member 7 of a semi-circular strip-like material such as a wire or a sheet material so that the member 7 is circumferentially movable with respect to the side walls 4 and 5, i.e., rotatable about the axis of the container. The movable member 7 is provided at its central portion with a weight 10 and at its opposite ends with clamp members 8, 8 on which are detechably mounted identification members 9 carrying thereon information or marks which indicate the content of the container.

The movable member 7 may alternatively have a circular shape. In this modification, the clamp member 8 may preferably be angularly spaced approximately 90 degrees from the weight 10 so that the identification members 9 are generally in diametrically opposite relationship to each other for the reason to be made apparent later.

The closure part 2 is provided with a cylindrical wall 11 axially extending from the flange portion 2′ thereof toward the flange portion 1′ of the body part 1 of the container. The arrangement is such that, when the body and closure parts 1 and 2 are secured together, the cylindrical wall 11 of the closure part 2 is snugly received in and engages with the cylindrical wall 4 of the body part 1, as shown in FIG. 2, to close the container. In this position of the container, the free end of the cylindrical wall 4 is snugly received in an annular groove 13 formed in the flange portion 2′ of the closure part 2 adjacent the radially outer surface of the root portion of the cylindrical wall 11. A packing 12 is disposed at the bottom of the annular groove 13 to seal the container. The outer cylindrical wall 5 is so dimensioned that it is in abutment contact at the free end with the inner surface of the flange portion 2′ when the container is in its closed position. In addition, the flange portions 2 and 2′ extend radially outwardly beyond the outer cylindrical wall 5 to protect the same. The outer cylindrical wall 5 may alternatively be formed on the flange portion 2′ of the closure part 2.

When the container is placed with its flat end surfaces oriented vertically, i.e., with the axis of the container extending substantially horizontally, as shown in FIG. 3, the movable member is always rotated by the gravity of the weight 10 to a position in which the weight 10 is positioned at the bottom of the circle of the container while the identification members 9 and 9 are positioned at diametrically opposed lateral side segments of the container so that a person can read the information on any of the identification members 9 through the transparent cylindrical outer wall 5 of the container.

The body and closure parts 1 and 2 of the container may be secured or clamped by any conventional means. The illustrated container is adapted to storage a material to which moisture is harmful, such as magnetic tape or movie film. For this purpose and in order to facilitate opening and closing of the container as well as to make it assured that the body and closure parts 1 and 2 are firmly secured together when such material is contained in the container, the latter is provided with a special securing means in addition to the engagement between the cylindrical walls 4 and 11 of the body and closure parts 1 and 2 of the container. The mentioned securing means comprises a spring 14, a space 15 defined by an inner surface 16 of a hub 17, a packing 18 disposed at a corner defined between the body part 1 and a cylindrical wall 19 formed thereon, a packing 20 disposed at a corner defined between the closure part 2 and a recessed wall portion 21 formed therein, hub 22 of the recessed wall portion 21, an aperture 23, a locking flange 24, an inclined surface 25, a head 26, a push button 27, a shaft 28, a seat 29, spring plates 30, support member 31, a support ring 32, a gripping ring 33, and a space 34. The securing means is not a part of the present invention and will not be described more specifically.

As described, the present invention provides an advantage that a person can ascertain the contents of a container by means of any one of the identification members 9, 9 which can automatically be located at the lateral sides of the container and read through the transparent cylindrical outer wall 5. Thus, the containers employing the identification apparatus of the present invention can be readily identified. This particularly contributes to an increase or improvement in the efficiency of business. In addition, the identification apparatus of the invention has a simplified structure and can be produced at a reduced cost of manufacture.

Referring then to FIGS. 4 to 7 of the drawings, there is shown a second embodiment of the invention. The embodiment comprises an annular frame 50 of a transparent plastic material. The frame may either be moulded from the plastic material or be made of a flexible strip material which is looped and has its opposite ends secured together by appropriate means. The annular frame 50 has radially outwardly extending annular beads 51, 51' formed along the opposite edges of the frame and has radially inwardly extending annular flanges 52, 52' which define therebetween a circumferentially extending groove 53.

Loosely and removably received in the groove 53 is a movable member 56 having an arcuate shape extending circumferentially around the frame 50 more than 180%. The arcuate movable member 56 is provided at the central portion with a weight 54 and at the opposite end portions with identification portions 55, 55'. The assembly is adapted to be mounted on the outer periphery of a cylindrical container 70. When the container is placed with its flat surfaces vertically extending, i.e., with the axis of the container extending substantially horizontally, the gravity of the weight 54 rotates the arcuate member 56 relative to the container 70 to a position in which the weight 54 is moved to the bottom of the periphery of the container while the identification portions 55 and 55' are moved to the lateral portions of the periphery of the container 70 so that the information carried by the identification portions 55 and 55' can be read from outside through the transparent frame 50.

The flanges 52 and 52' may preferably be formed therein with cavities **52*a* and 52*a'* so that the flanges may resilliently engage with the outer periphery of the container 70. Alternatively, the flanges 52 and 52'** may be made from a resilient material such as rubber or plastic material such as, for example, foamed styrene.

Figure 7:
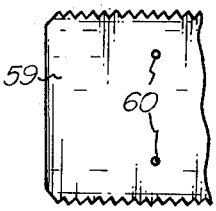
FIG. 7 is an enlarged fragmentary plan view of a fastening band employed in the second embodiment.

In the case where the annular frame 50 is made of a looped strip material, the ends of the strip material may preferably be secured together by means of dovetail joint. Alternatively, a recess 58 may be formed in the inner surface of each of the outer beads 51, 51'. A length of a securing band 59 of a thinner sheet material having notched edges, as shown in FIG. 7, may be wound around the looped strip so that the notched edges extend into and engage the recesses 58, 58 in the beads 51, 51'. Moreover, the securing band 59 may be formed therein with apertures 60, 60 in which an adhesive may be placed to firmly secured the ends of the looped band.

When it is required to mount the identification apparatus of the second embodiment of the invention on a container 70, the annular frame 50 will be first secured to the closure part 71 of the container (upper part of the illustrated container) so that the peripheral inner edges of the flanges 52, 52' abut the outer surface of the cylindrical wall of the closure part 71 of the container 70. Then the closure part of the container 70 with the identification apparatus carried thereby will be placed over the body part 72 of the container 70 (lower part of the illustrated container) so that the cylindrical walls of the closure and body parts 71 and 72 of the container 70 are snugly received one on the other. The closure and body parts may be fastened together by appropriate conventional fastening or clamping means.

The second embodiment of the present invention is particularly advantageous in that the identification apparatus of a selected size can be detachably mounted on a conventional cylindrical container. The arcuate movable member 56 disposed within the circumferentially extending groove 53 is rotatable about the axis of the container, i.e., movable along the groove, so that the identification portions 55 and 55' are positioned at lateral sides of the container for the identification of the content of the container. It is only required that the container is so placed that the flat end faces of the container extend substantially vertically. The apparatus of the present invention is operable even in the case where a plurality of containers are placed end to end contacting relationship with each other. A desired container can be readily identified and taken out from a row of such containers. This greatly increases the efficiency of business. The apparatus of the present invention has a simplified construction and thus can be manufactured economically. Moreover, the diameter of the annular frame 50 formed of a looped strip material may be re-adjusted by separating the connected ends of the loop, shortening the circumferential dimension of the loop by cutting one or both ends and, by securing the new ends of the shortened loop to form an adjusted frame.

Still more, resilient annular flanges 52, 52' firmly secure the frame 50 onto a mating container and, in addition, advantageously serve as a shock absorber which protects the container and the material contained therein when a pressure or shock is exerted against the outer beads 51, 51' on the frame 50.

What is claimed is:

1. An identification apparatus for a cylindrical container, said apparatus comprising a movable member rotatably mounted on a periphery of said container,, the periphery being formed in the container with an annular space, said movable member having identification portions and being semicircular and received in said annular space for rotation about the axis of said container, said movable member being adapted to be rotated by gravity of a weight with respect to the container, there being a weight mounted on said movable member and adapted to move said identification portions to lateral sides of the periphery of said container when the container is in its vertical position whereby said identification portions can be seen.

2. An identification apparatus as claimed in claim 1,, there being clamp members on the ends of said movable member, said identification portions being secured to said movable member by means of said clamp members.

3. An identification apparatus adapted to be mounted on a container, said apparatus comprising an annular frame of a transparent material having inwardly extending annular flanges defining therebetween a circumferential groove, a semi-circular movable member detachably received in said groove for rotation about the axis of said container, said movable member having identification portions at the ends and a weight mounted on said movable member at the central portion thereof, said frame and movable member being adapted to be removably mounted on the outer periphery of said container, said movable member being adapted to be rotated by action of gravity on said weight about the axis of said container when the container is in its vertical position whereby said identification portions can be automatically moved to lateral sides of the periphery of said container, said annular flanges being formed into hollow shapes such that the flanges resiliently engage with the outer peripheral surface of said container.

4. An identification apparatus adapted to be mounted on a container, said apparatus comprising an annular frame of a transparent material having inwardly extending annular flanges defining therebetween a circumferential groove, a semi-circular movable member detachably received in said groove for rotation about the axis of said container, said movable member having identification portions at the ends and a weight mounted on said movable member at the central portion thereof, said frame and movable member being adapted to be removably mounted on the outer periphery of said container, said movable member being adapted to be rotated by action of gravity on said weight about the axis of said container when the container is in its vertical position whereby said identification portions can be automatically moved to lateral sides of the periphery of said container, said annular flanges being made of a resilient material such that the flanges resiliently engage with the outer peripheral surface of said container.

* * * * *